United States Patent [19]

Juleff

[11] Patent Number: 4,720,092

[45] Date of Patent: Jan. 19, 1988

[54] LOCKED BILL STACKER

[75] Inventor: David C. Juleff, Kalamazoo, Mich.

[73] Assignee: Rowe International Inc., Whippany, N.J.

[21] Appl. No.: 817,528

[22] Filed: Jan. 9, 1986

[51] Int. Cl.[4] ..... B65H 31/00

[52] U.S. Cl. ..... 271/207; 271/163; 221/197; 221/287; 221/154

[58] Field of Search ..... 271/213, 214, 220, 147, 271/160, 163; 221/198; 109/23, 45, 47, 52, 59 R; 209/534

[56] References Cited

U.S. PATENT DOCUMENTS

| | | | |
|---|---|---|---|
| 4,045,017 | 8/1977 | Lundblad | 271/181 |
| 4,113,140 | 9/1978 | Graef et al. | 221/6 |
| 4,189,139 | 2/1980 | Uchida et al. | 271/162 |
| 4,235,433 | 11/1980 | Hirata | 271/162 |
| 4,283,097 | 8/1981 | Lundblad | 271/145 X |
| 4,312,277 | 1/1982 | Graef et al. | 271/275 X |
| 4,313,601 | 2/1982 | Graef et al. | 271/207 |
| 4,434,931 | 3/1984 | Hunt et al. . | |
| 4,552,075 | 11/1985 | Glasson et al. | 109/59 R X |

FOREIGN PATENT DOCUMENTS

| | | | |
|---|---|---|---|
| 2039264 | 8/1980 | United Kingdom | 221/198 |

*Primary Examiner*—F. J. Bartuska
*Assistant Examiner*—David H. Bollinger
*Attorney, Agent, or Firm*—Shenier & O'Connor

[57] ABSTRACT

A locked bill stacker in which a slide is mounted on the cash box for movement between a first position at which it blocks the mouth of the cash box and a second position at which the mouth is open. When the stacker is in operative relationship with a bill acceptor, movement of the slide from the first to the second position locks the stacker to the acceptor. When the slide is moved from the second position to the first position the slide is locked in the first position. A latch is provided to prevent the slide from accidentally moving from the first position to the second position before the stacker is positioned in operative relationship with the acceptor.

5 Claims, 7 Drawing Figures

3

LOCKED BILL STACKER

FIELD OF THE INVENTION

My invention is in the field of apparatus for stacking bills such as currency notes and, more particularly, a bill stacking apparatus which is automatically locked against access to the interior of the stacker after it is removed from the associated bill handler.

BACKGROUND OF THE INVENTION

There are known in the prior art devices which receive bills such as currency notes which are examined for authenticity and if genuine are accepted, and in return for which change may be given or articles or services provided. Associated with these bill acceptors are bill stacker devices which are adapted to receive bills from the acceptor and to arrange them in a relatively compact stack until the stacker reaches its capacity. One such bill stacker is illustrated in Okkonen et al U.S. Pat. No. 3,917,260, issued Nov. 4, 1975.

In most instances, bill handling apparatus of the type just described is installed at an unattended location, normally behind the locked door of a merchandising machine or the like. At timed intervals a service person visits the location to service the machine and to remove whatever money has been accepted by the machine and return it to the home office. It is of course desirable that this operation be carried out in as simple and expeditious as well as safe method as is possible. To that end, it is desirable that the cash receptacle be readily removable from the remainder of the bill acceptor structure. It is further desirable that the bill acceptor cash box be automatically locked against access to the bills therein upon its removal from the acceptor. In this way dishonest persons will not have access to the notes which have been collected. It is further desirable that the bill acceptor be disabled when the stacker box is not in operative position with relation thereto.

SUMMARY OF THE INVENTION

One object of my invention is to provide a locked bill stacker which prevents access to the interior of the cash box after the stacker has been removed from its associated acceptor.

Another object of my invention is to provide a locked bill stacker which is automatically locked in association with the bill acceptor when the entry blocking slide is moved to open position.

A further object of my invention is to provide a locked bill stacker having a cash box entry blocking slide which cannot accidentally be moved to open position from a cocked position before being mounted in operative relationship with a bill acceptor.

Yet another object of my invention is to provide a locked bill stacker which is simple in construction and certain in operation for the result achieved thereby.

Other and further objects of my invention will appear from the following description.

BRIEF DESCRIPTION OF THE DRAWINGS

In the accompanying drawings to which reference is made in the instant specification and which is to be read in conjunction therewith and in which like reference numerals are used to indicate like parts in the various views.

DESCRIPTION OF THE PREFERRED EMBODIMENT

Figure 1:
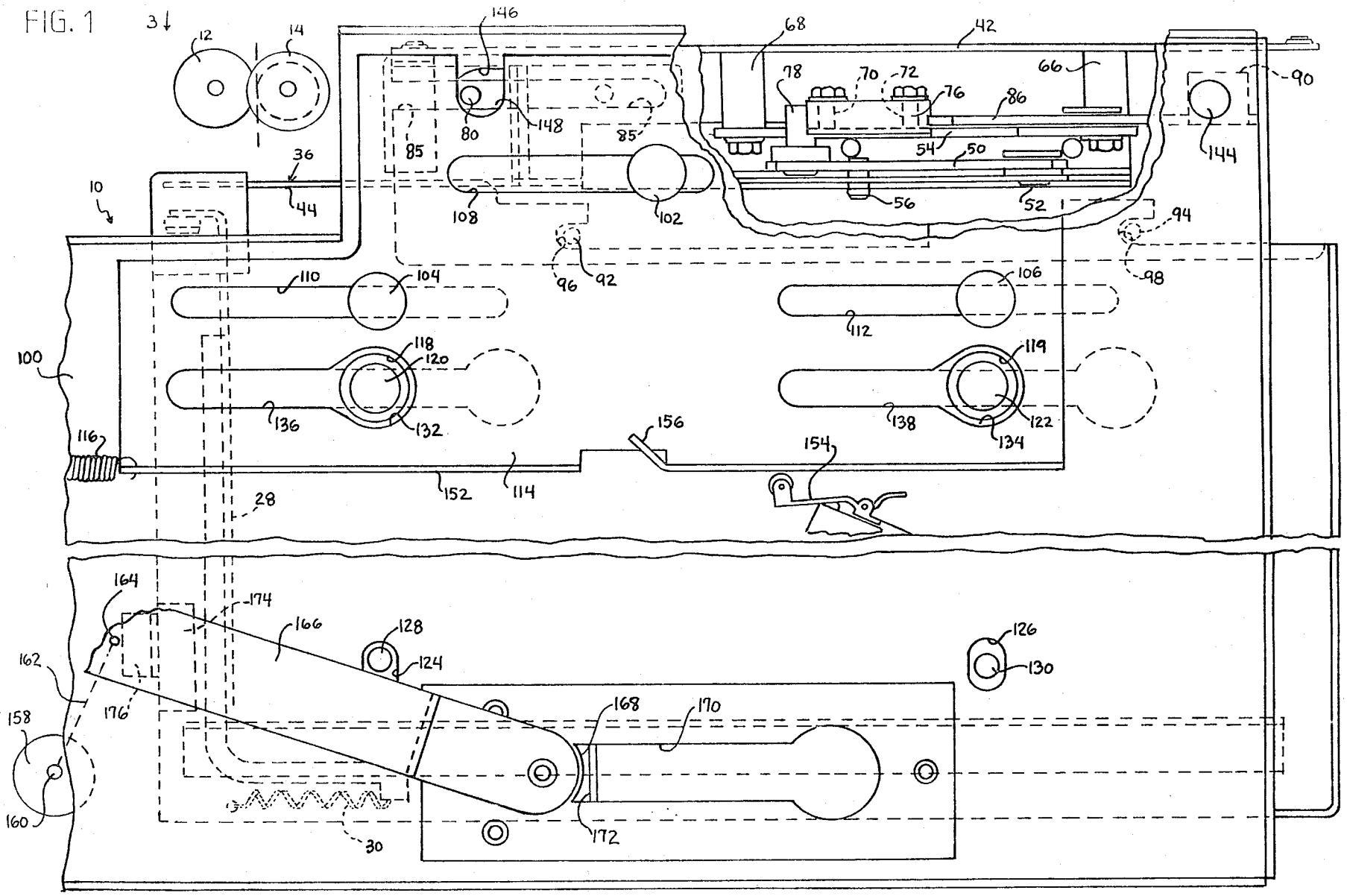
FIG. 1 is a side elevation of my locked bill stacker in association with a bill acceptor and with parts broken away.
Figure 2:
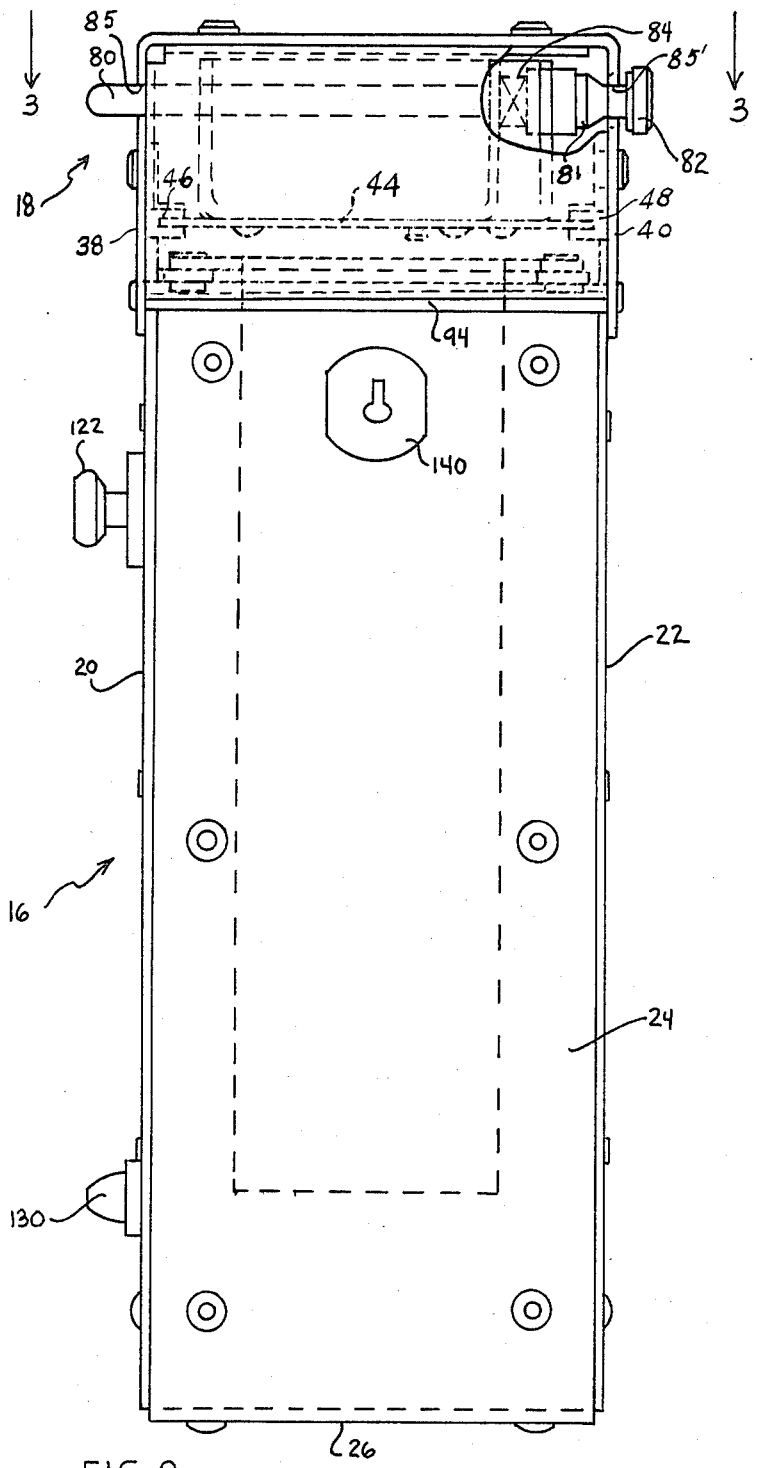
FIG. 2 is an end elevation of my locked bill stacker removed from association with a bill acceptor.
Figure 3:
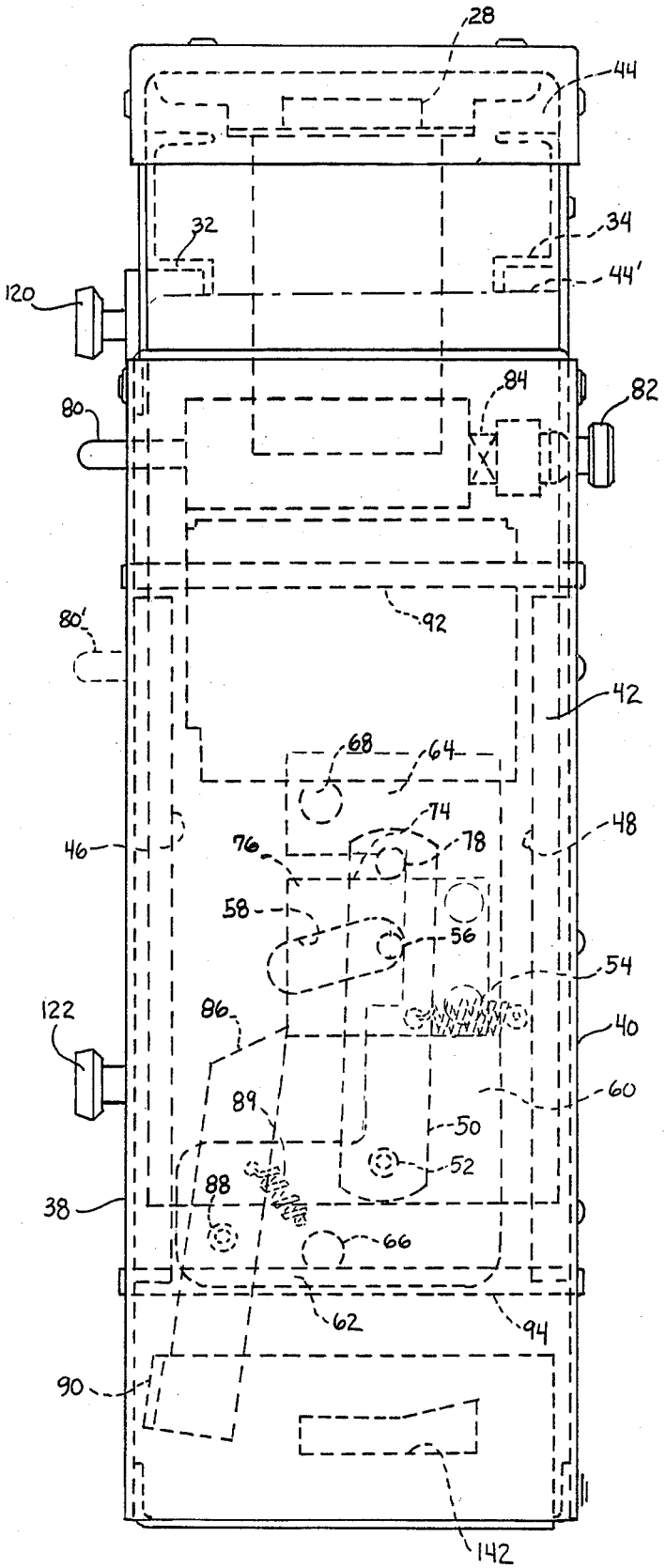
FIG. 3 is a top plan of my locked bill acceptor taken along the line 3—3 of FIG. 2.
Figure 4:
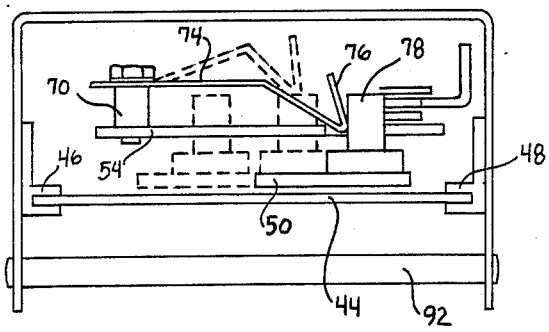
FIG. 4 is an end elevation of a portion of the operating mechanism on the cover of my locked bill stacker.

Referring now to FIGS. 1 to 4 of the drawings, my locked bill acceptor indicated generally by the reference character 10 is adapted to be assembled in operative relationship with the output rollers 12 and 14 of a bill acceptor with which the stacker is associated.

The stacker 10 includes a cash box indicated generally by the reference character 16 and a cover assembly indicated generally by the reference character 18. The box 16 has side walls 20 and 22 and end wall 24 and a bottom 26. A plunger 28 in the bill box normally is urged by a spring 30 to a position at the left of FIG. 1 in which a bill can be inserted in the box behind the plunger in a manner to be described. Plunger 28 is adapted to be driven in a manner to be described hereinbelow to drive a bill which is inserted in the stacker on end behind a pair of bill retaining flanges 32 and 34. Bills are adapted to move into the stacker 10 through a mouth indicated generally by the reference character 36.

The cover assembly 18 includes sides 38 and 40, a top 42 and a stacker box mouth-closing slide 44, slideable in guides 46 and 48, supported on the cover adjacent to the sides 38 and 40. I mount an arm 50 on a pivot pin 52 on the slide 44. A spring 54 connected between a hole on the arm 50 and a pin on the slide 44 urges the arm 50 to pivot to a position at which a pin 56 on the arm 50 is at one end of an inclined slot 58 in the slide 44.

A generally U-shaped control bracket 60 having a pair of arms 62 and 64 is secured to the top 42 by means of bolts or the like which pass through spacers 66 and 68.

Screws or the like extending through spacers 70 and 72 secure a control leaf spring 74 into position on the bracket 60. The spring 74 has an end 76 which is bent downwardly and then back to form a generally V-shape as viewed from the edge of the spring in FIG. 4.

The end of the arm 50 remote from the pivot pin 52 carries a pin 78 which is adapted to cooperate with the leaf spring 74 and the bracket 60 in a manner to be described hereinbelow.

Slide 44 carries for movement therewith a rod 80 having a larger diameter portion 81 and a knob 82 at one end of thereof and axially positioned by a spring 84. This rod extends through open-ended slots 85 and 85' formed in the sides 38 and 40 of the cover.

I mount a locking latch 86 on a pivot pin 88 on the bracket 60. A spring 89 normally urges the latch 86 to a position at which an end thereof engages the outer surface of the end portion 76 of the spring 74. I form the latch 86 with a flange 90 adapted to be engaged by a pin to be described hereinafter on the bill stacker mounting plate when the stacker is in operative position.

A pair of spaced rods, 92 and 94, extending between the sides 38 and 40 of the cover assembly 18 are adapted to engage in respective pairs of notches 96 and 98 in the sides 20 and 22 of the stacker cash box when the cover assembly os placed on the box. The cover assembly is locked in position on the box by means of a lock 140, the operative element of which engages in a slot 142 in the cover to hold the cover in position on the box.

The apparatus with which my locked bill stacker is used includes a mounting plate 100 carrying three pins, 102, 104 and 106, which are received in respective slots 108, 110 and 112 in a locking plate 114, thus to mount the plate 114 for sliding movement on the support 100. A spring 116 normally urges locking plate 114 to the left, as viewed in FIG. 1, until the pins 102, 104 and 106 are in the right ends of the slots 108, 110 and 112. The cash box carries a pair of headed pins 120 and 122 which are adapted to be inserted through spaced openings 118 and 119 in the support 100 when the bill acceptor is positioned on the support. When this operation is performed, another pair of holes 124 and 126 on the support 100 receive locating pins 128 and 130 on the side of the cash box. As the bill stacker is mounted on the support 100 in this manner, the heads of pins 120 and 122 extend into enlarged ends 132 and 134 of a pair of slots 136 and 138. From the structure just described, it will readily be apparent that when the locking plate 114 is moved to the right, as viewed in FIG. 1, slots 136 and 138 will ride under the heads of the pins 120 to hold the assembly firmly in place.

When the bill stacker is positioned on the support 100, a projection 144 on the support engages the end flange 90 of the latching arm 86 to move the latching arm out of the position at which it prevents the slide 44 from being moved to an open position.

When the bill stacker is first placed in position on the support 100, pin 80 extends through the slot 85 in the side 38 through an opening 146 in support 100 and to a notch 148 in the upper edge of the locking slide 114. I form the slide 114 with a bottom flange 152 which normally engages a switch arm 154 to hold the switch closed. When the locking slide 114 is moved to locking position in a manner to be described, the flange 152 rides along the follower on arm 154 until a bent-up portion 156 of the flange permits the switch arm to move up to cause the switch to indicate that the stacker is locked in position on its support 100.

Support 100 also carries a stacker plunger drive motor 158 having a shaft 160 connected by a crank 162 to a pivot pin 164 on a link 166. Link 166 carries a roller 168 which extends through a slot 170, so that the roller can engage an abutment 172 to drive the plunger 28 against the action of spring 30 as the motor 158 makes the revolution.

I mount a magnet 174 on plunger 28. As the plunger moves forward in the action of stacking a validated note and then returns to home position a sensor 176 on support 100 goes through closed, open, closed conditions. The bill acceptor (not shown) with which my stacker is used must "see" these conditions of sensor 176 before it operates. Conversely, when the stacker is not in position on support 100 the acceptor will not operate.

Figure 5:
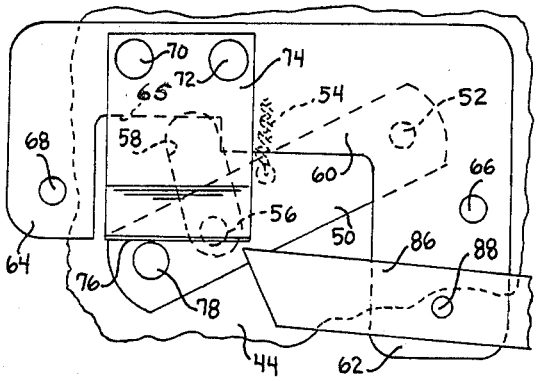
FIG. 5 is a fragmentary view illustrating relative positions of parts of the control mechanism of my locked bill stacker in the reset position.
Figure 6:
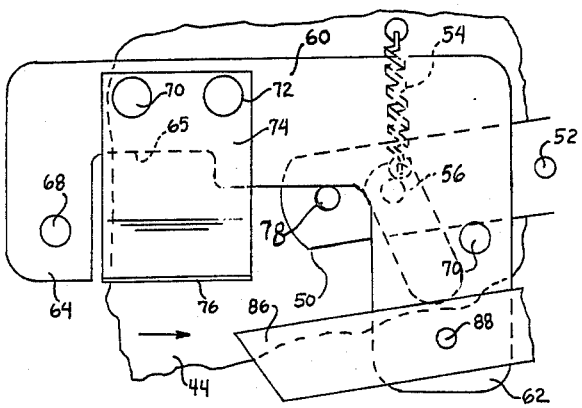
FIG. 6 is a fragmentary view illustrating the relative positions of some of the parts of the control mechanism of my locked bill stacker in the slide open position of the cash box entry slide.
Figure 7:
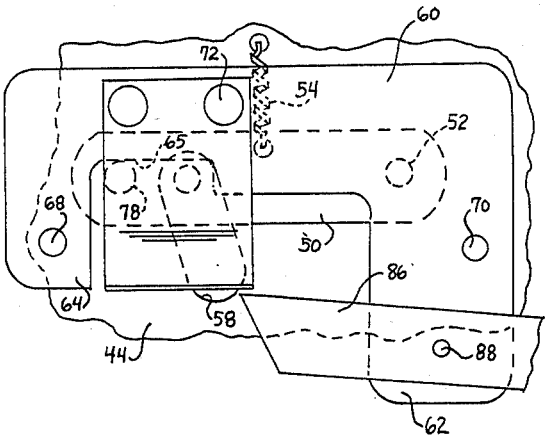
FIG. 7 is a fragmentary view illustrating the relative positions of the operating parts of the control mechanism of my locked bill stacker with the cash box entry slide locked in cash box entry locking position.

The operation of my locked bill stacker can best be understood by reference to FIGS. 5 to 7. When the empty bill stacker is brought to the installation at which it is to be placed in cooperative relationship with a bill acceptor, slide 44 occupies its closed position, illustrated in full lines in FIG. 3, and the parts of the control mechanism occupy the relative positions shown in FIG. 5. In this position of the parts, pin 78 rests against the upturned outer edge 76 of spring 74. At the same time the locking latch 86 is urged by its spring 89 to a position at which the left end thereof, as viewed in FIG. 5, abuts the spring end 76. If now, in these positions of the parts, an attempt is made to open the slide 44 by moving it to the right as viewed in FIG. 5, the end of the latch 86 will be in the path of the pin 78 so that the slide cannot be moved to its open position. Next the bill stacker is placed in position on the support 100. It will be appreciated that pin pin 78 and latch 86 in the reset condition of the apparatus constitute means operable in the reset condition of the operating mechanism for releasably preventing movement of the slide 44 from its closed position to its open position. As has been pointed out hereinabove, when this is done the projection 144 engages the flange 90 to move the latch 86 to a position at which it is out of the path of pin 78. Projection 144 and the flange 90 constitute means responsive to mounting of the stacker on the acceptor for releasing the means which initially prevents movement of the slide from its closed position to its open position. At the same time, the end of pin 80 extends through opening 146 in plate 100 and into the notch 148 in the locking slide 114. The slide 44 is then moved to the right as viewed in FIG. 6 by means of the knob 82 until the pin 78 rides off the upturned end 76 of the spring 74. When that occurs spring 54 pivots arm 50 to a position at which the pin 78 engages the surface of the control bracket 60 between the legs 62 and 64. The slide 44 is then in the dot dash position 44' illustrated in FIG. 3 and the relative positions of the parts of the control mechanism are as shown in FIG. 6. At the same time the locking slide 114 has been moved to a position at which the slots 136 and 138 ride under the heads 120 and 122 to hold the stacker in position.

When slide 44 has been moved to its open position, spring 84 moves pin 80 axially so that portion 81 moves into an enlargement of slot 85' to hold the slide 44 in its open position. Pin 80 cooperating with the enlargement of slot 85' forms means responsive to movement of the slide 44 from its closed position to its open position following release of latch 86 for releasably holding the slide 44 in its open position.

When the stacker is full or when the serviceman is making a routine service call, he can remove the stacker from its assembled position on the support 100. Knob 82 is pushed in and slide 44 is moved to the left, as viewed in FIG. 6. When this occurs spring 54 pivots the arm 50 in a clockwise direction, as viewed in FIG. 6, to cause pin 78 to move into a recess 65 formed in the edge of the bracket between its legs 62 and 64. At the same time spring 116 returns the locking plate 114 to its released position at which the stacker can be removed from the support 100.

Following the operation just described, the slide 44 is in the position at which it blocks the mouth 36. Pin 78 is in recess 65 so that the slide is locked in this position and cannot be moved without removing the cover from the cashbox. Pin 78 and the edge of recess 65 cooperate to form the means responsive to movement of the slide 44 to its closed position for locking the slide in that position.

When the stacker is returned to the home office, the cover assembly 18 is removed from the bill box 16 by opening tho lock 140. The contents of the box can then be removed. Before the stacker is returned to service, arm 50 is pivoted by means of pin 56 protruding through slot 58 on underside of cover assembly 18. As this motion is performed, spring 74 is cammed upward by pin 78 (FIG. 4) until pin 78 clears spring 74. Arm 50 is then in the reset position of FIG. 5. The cover assembly then is replaced on the box and is locked in position by means of the lock 140. The stacker is then ready to be returned to the field.

It will be seen that I have accomplished the objects of my invention. I have provided a locked bill stacker which prevents access to the interior of the cash box after the stacker has been removed from its associated acceptor. It is automatically locked in association with the bill acceptor when the entry blocking slide is moved to open position. The entry blocking slide of my locked bill acceptor cannot accidentally be moved to open position from a cocked position before being mounted in operative relationship with a bill acceptor. My locked bill acceptor is simple in construction and certain in operation for the result achieved thereby.

It will be understood that certain features and subcombinations are of utility and may be employed without reference to other features and subcombinations. This is contemplated by and is within the scope of my claims. It is further obvious that various changes may be made in details within the scope of my claims without departing from the spirit of my invention. It is, therefore, to be understood that my invention is not to be limited to the specific details shown and described.

Having thus described my invention, what I claim is:

1. A bill stacker including in combination, a box adapted to receive a stack of bills, said box having an inlet opening through which individual bills are fed into the box, a closure member, means mounting said closure member on said box for movement between a first position at which said inlet is closed and a second position at which said inlet opening is open, and an operating mechanism for contorlling the movement of said closure member between said first and second positions, said operating mechanism comprising first means operable in a reset condition of said operating mechanism for releasably preventing movement of said closure member from said first position to said second position, second means responsive to movement of said closure member from said first position to said second position following release of said first means for releasably holding said closure member in said second position, and third means responsive to movement of said closure member from said second position to said first position for locking said closure member against movement from said first position to said second position, said closure member being a slide, said operating mechanism comprising an arm and means mounting said arm for pivotal movement on a pivot on said slide and a pin fixed on said arm and means biasing said arm for movement around said pivot, said first means operable in said reset condition comprising means for retaining said arm in a first angular position and releasable first means for blocking movement of said pin in response to movement of said slide from said first position toward said second position, said third means responsive to movement of said closure member comprising means for holding said arm in a second angular position and rigid means for blocking movement of said pin in response to movement of said slide from said first position toward said second position.

2. A bill stacker as in claim 1 in which said releasable first means comprises a latch, means mounting said latch for pivotal movement between a pin blocking position and an unblocking position, and means for biasing said latch to said pin blocking position.

3. A bill stacker as in claim 1 in which said means for holding said arm in said second angular position comprises a bracket having an edge against which said pin bears in the second position of said arm, said third means responsive to movement of said slide comprising a recess in said bracket edge.

4. A bill stacker as in claim 1 in which said second means responsive to movement of said slide comprises means for holding said arm in a third angular position intermediate said first and second angular positions.

5. A bill stacker having an inlet for receiving bills from a bill acceptor or the like with which said stacker is associated including in combination, a box for receiving a stack of bills fed to said stacker through said inlet, a closure member, means mounting said closure member on said box for movement between a first position at which it closes said inlet and a second position at which said inlet is open, means for mounting said stacker in operative relationship with said bill acceptor, manually releasable latching means operable upon movement of said closure member from said first position to said second position for concomitantly latching said closure member in said second position and locking said stacker in operative relationship with said acceptor, means responsive to movement of said closure member from said second position to said first position upon release of said latching means for locking said closure member against return movement to said second position, second releasable means for initially presenting movement of said closure member from said first position to said second position, and means responsive to mounting of said stacker on said acceptor for releasing said second releasable means.

* * * * *

UNITED STATES PATENT AND TRADEMARK OFFICE

CERTIFICATE OF CORRECTION

PATENT NO. : 4,720,092

DATED : January 19, 1988

INVENTOR(S) : David C. Juleff

It is certified that error appears in the above-identified patent and that said Letters Patent are hereby corrected as shown below:

In the Claims:

Claim 1, col. 5, line 46, change "contorlling" to --controlling--;

Claim 5, col. 6, line 52, change "presenting" to --preventing--.

Signed and Sealed this

Thirty-first Day of May, 1988

*Attest:*

DONALD J. QUIGG

*Attesting Officer*

*Commissioner of Patents and Trademarks*